United States Patent [19]

Tibussek

[11] 4,454,923

[45] Jun. 19, 1984

[54] HOLDING DEVICE FOR BORING HEAD TOOLS OR THE LIKE

[75] Inventor: Fritz Tibussek, Monchen-Gladbach, Fed. Rep. of Germany

[73] Assignee: Wirth Maschinen-und Bohrgerate-Fabrik GmbH, Erkelenz, Fed. Rep. of Germany

[21] Appl. No.: 406,502

[22] Filed: Aug. 9, 1982

[30] Foreign Application Priority Data

Aug. 17, 1981 [DE] Fed. Rep. of Germany ..... 3132345

[51] Int. Cl.[3] ..... E21B 10/20

[52] U.S. Cl. ..... 175/363; 299/86; 384/157

[58] Field of Search ..... 175/363, 361, 364; 299/86, 90; 308/181; 384/157, 442–444

[56] References Cited

U.S. PATENT DOCUMENTS

| | | | |
|---|---|---|---|
| 916,242 | 3/1909 | Winborne | 384/266 |
| 3,191,699 | 6/1965 | Robins et al. | 175/374 |
| 3,444,939 | 5/1969 | Bechem et al. | 175/334 |
| 3,601,207 | 5/1969 | Coski et al. | 299/86 X |
| 3,612,196 | 10/1971 | Divan | 175/364 |
| 3,756,332 | 9/1973 | Crane | 175/364 |
| 3,787,101 | 1/1974 | Sugden | 175/364 X |
| 3,835,944 | 9/1974 | Bingham | 175/364 |
| 4,193,637 | 3/1980 | Spencer | 299/86 X |
| 4,202,418 | 5/1980 | Waddell | 175/363 X |
| 4,241,799 | 12/1980 | Going | 175/361 |

FOREIGN PATENT DOCUMENTS 2812686 9/1979 Fed. Rep. of Germany .

*Primary Examiner*—Ernest R. Purser
*Assistant Examiner*—Thuy M. Bui
*Attorney, Agent, or Firm*—Holman & Stern

[57] ABSTRACT

A holding device for a boring head tool and the tool itself are arranged so that the tool can be mounted from the rear of the boring head. The tool is mounted on a supporting member which has head parts provided with supporting faces and the holding device has rigid support surfaces for engaging the supporting faces of the tool. The support surfaces are directed towards the front of the holding device and the holding device also has passages extending from the rear to in front of the rigid support surfaces as to allow the passage therethrough of the head parts for assembly. The head parts are conveyed through the passages in rotated positions offset with respect to their position in the assembled state and then moved to an assembly position in which the contact surfaces of the tool are held against the rigid support surfaces of the holding device by fastening screws which engage in threaded bores of the head parts.

14 Claims, 9 Drawing Figures

HOLDING DEVICE FOR BORING HEAD TOOLS OR THE LIKE

BACKGROUND TO THE INVENTION

1. Field of the Invention

The invention relates to a holding device or tool holder for boring head tools such as cutting rollers, cutting tools and the like which can be mounted from the rear of the boring head, in particular boring heads of tunnel boring machines, large hole boring machines, shaft boring machines or the like.

2. Description of the Prior Art

Cutting rollers or similar tools are usually attached in holding devices on the front of a boring head. Thus in the case of a tunnel boring machine with the front side facing the face, it is only possible to change the tools when there is access to this front side. In many cases this causes great difficulties and usually also involves dangerous and complicated work. It is therefore especially important to try to find a way of mounting tools from the rear of a boring head.

An extension boring head is known from U.S. Pat. No. 3,444,939 in which cutting rollers are mounted on the inside of the boring head. The bearing covers laid to the rear are fastened by threaded bolts to front bearing pieces or boring head parts. The high stresses occurring during operation must be completely absorbed by the bolts which are thereby subject to the risk of breaking away or fracturing.

Moveover, a holding device for cutting rollers of the type discussed above has become known from U.S. Pat. No. 4,202,418 in which head parts of an unrotatable supporting body designated as a stator can be inserted in a straight line from the rear of the boring head into an accommodating housing forming the holding device until they rest against the front abutments. Intermediate pieces with support surfaces which are substantially forwardly directed, i.e. towards the front of the boring head, are inserted between portions of the head parts which are directed to the rear and stop faces in the holder. The intermediate pieces are held by fastening screws which either engage through bores in the intermediate pieces and are screwed into the holder or which pass through holes in the holder and are screwed into the intermediate pieces or which engage both through bores in the holder and in the intermediate pieces and are screwed into the head parts of the supporting body of the tool. It is only possible to insert the intermediate pieces when the tool which has previously been inserted into the mounting is held in its final position against the abutments. The screwing processes must then be carried out and both the tool and the intermediate pieces must be held.

SUMMARY OF THE INVENTION

It is an object of the invention to produce a holding device, or tool holder, for boring head tools which makes it possible to mount the tools from the rear of the boring head or a similar tool carrier and ensures that the tools are accommodated securely and firmly without the operating stresses being absorbed by the threaded bolts alone and without additional intermediate pieces which need to be inserted for the support. The invention also provides an improved construction of the holding device and its parts individually.

According to the invention there is provided, a holding device for boring head tools or the like together with at least one tool fixed to a supporting member which has head parts provided with contact faces and threaded bores, and fastening screws for fastening the tool to the holding device, the holding device having a front, a rear, rigid support surfaces within the holding device for directly mounting the contact surfaces of the head parts and directed substantially towards the front of the holding device, and passages leading from the rear of the holding device to in front of the rigid support surfaces, the passages being arranged such that the head parts of the supporting member can be conveyed therethrough in rotated or pivoted position offset with respect to the assembled state of the tool and thereby the tool can be moved into the assembled state with a compound movement which includes a rotation or pivoting of at least one of its parts, in which assembled state the contact surfaces of the head parts are held on the rigid support surfaces by fastening screws engaging in the threaded bores of the head parts.

The tool can be mounted and dismounted in such a holding device in a simple manner from the rear of the boring head. It can be assembled merely by carrying out uncomplicated movements and is securely supported in its assembly position by rigid parts so that the stresses occurring during operation are also absorbed without difficulty. No intermediate elements are required which would have to be inserted separately.

The contact surfaces can be arranged in various ways. For example, they may be provided on portions of the head parts directed substantially axially or extending in the longitudinal direction of the supporting member or a part corresponding to the latter or on portions of the head parts directed substantially radially or lying diametrically opposite in the transverse direction of the supporting member or of a corresponding part. Attachments on the head parts or on the supporting member also come under this category. The path of the tool during movement into its assembled state can be different according to the position and construction of the contact surfaces.

In the simplest case the contact surfaces on the head parts can be arranged in a similar manner to spanner engaging surfaces on a threaded bolt or the like. The principle according to the invention can be implemented with head parts of which the longitudinal dimensions are greater in one direction than the width dimensions in a direction which is transverse thereto, the longitudinal dimensions only requiring to be sufficient to form the contact surfaces. Furthermore, there are numerous further constructional possibilities as will be explained hereinafter.

The course of movement during the insertion of a tool into its holding device and the construction of the holding device which makes this process possible can in a certain respect be compared with that of locking two parts to one another. There are several possibilities for the rotational movement. In one embodiment the supporting member with its head parts, after a previous forward movement in which the head parts are orientated such that sides of the head parts face in the direction of movement while the longer contact surfaces are parallel to the direction of movement, is rotated through an angle, in particular 90°, such that the contact surfaces come to lie parallel to the rigid support surfaces and only a small reverse movement of the tool is required in order to bring these surfaces to rest. In another embodiment the tool, after the forward movement in which the head parts of the supporting member are advantageously at least substantially in an orientation corresponding to the assembled state, is rotated about an axis perpendicular to the axis of the supporting body, and this movement of the head parts can also be understood as a pivoting movement, until the contact surfaces lie opposite the rigid support surfaces, whereupon a small reverse movement occurs until the surfaces abut against one another.

The arrangement suited for the first mentioned embodiment consists in that at least one part of the passages for the head parts is formed by grooves which terminate at the support surfaces and are of a size such that the head parts can be pushed through them in a orientation rotated by 90° with respect to the assembled state. In this case the grooves only require to have a cross section which is slightly greater than the smaller cross section of the head parts. This is a very simple and advantageous construction.

Furthermore the threaded bores in the head parts of the supporting member are advantageously arranged such that the fastening screws extend through the grooves in the assembled state of the tool. Not only does this result in an optimum use of space but also particularly favorable force relations.

For the second embodiment mentioned advantageously at least some of the passages are in the form of grooves, openings or extensions of the holding device offset in a peripheral direction with respect to the rigid support surfaces, the grooves, openings or extensions communicating with a region of the support surfaces so as to allow a passage for the head parts. A construction which allows the head parts to move in to the assembled state in the manner of a bayonet catch or in the sense of a similar locking movement comes into this category. The head parts can be guided along the complete path or along a part of the path by grooves or other passages. However, the holding device can also comprise recesses or extensions of a size such that the tool with the head pieces can be moved substantially freely into the assembly position.

In the basic form the head parts of the supporting member in each case have a large dimension in one direction and transversely with respect to the latter a small dimension and can e.g. be rectangular in shape. Advantageously, the head parts have contact surfaces, which are inclined with respect to an axial plane of the tool, the support surfaces in the holding device being correspondingly inclined. This ensures inter alia a secure hold and results in favorable force relations. Preferably, the contact surfaces of each head part are equally inclined to the axial plane, in particular such that there is a symmetrical triangular-shaped cross sectional form.

Assembly is thereby made even simpler. The grooves or other passages can be kept correspondingly small and this has a favourable effect on the use of space and on the rigidity of the support.

Each head part may, however, have contact surfaces constructed so as to be roof-shaped at least on one side, the support surfaces in the holder being correspondingly roof-shaped. By such a prismatic arrangement a very advantageous positioning of the head parts and thus of the tool and favourable absorption of the forces is obtained. The roof-shaped construction can be such that the "ridge" i.e. the edge or a flattened region from which the surfaces slope to either side in a transverse direction, extends parallel to the axis or with respect to a longitudinal central plane of the supporting body. The "ridge" can in particular also be inclined so that acordingly the roof surfaces are simultaneously inclined as a tapering to the end. This results in a further centering effect in the case of stable support.

In all embodiments that the inclinations in each case of contact and support surfaces can be selected such that these surfaces lie at least partially perpendicular to the main stressing direction of the tool during operation.

There is extensive freedom for the construction of the holder so that varying circumstances and applications can be met without difficulty. The holder can be closed to a large extent at its front and only allow the passage of the tool body with its working part. It can also comprise attachments or the like at some points or at its edge region which restrict the forward path of the head parts when the tool is inserted into the holder although it is not important for securing it in the assembly position.

The holding device can be a member provided with support surfaces and connected directly to a boring head or to another tool carrier. It is also within the scope of the invention to provide the support surfaces directly on a boring head or the like so that in this case the region in question of the boring head itself embodies a holding device in the manner of the invention.

Furthermore the holding device may comprise a base member and an insert releasably connected to the base member, the rigid support surfaces being on the insert. The base member is fastened to the boring head, but can however be formed by the same. Advantageously, the insert has a substantially cylindrical outer wall.

DESCRIPTION OF PREFERRED EMBODIMENTS

Figure 1:
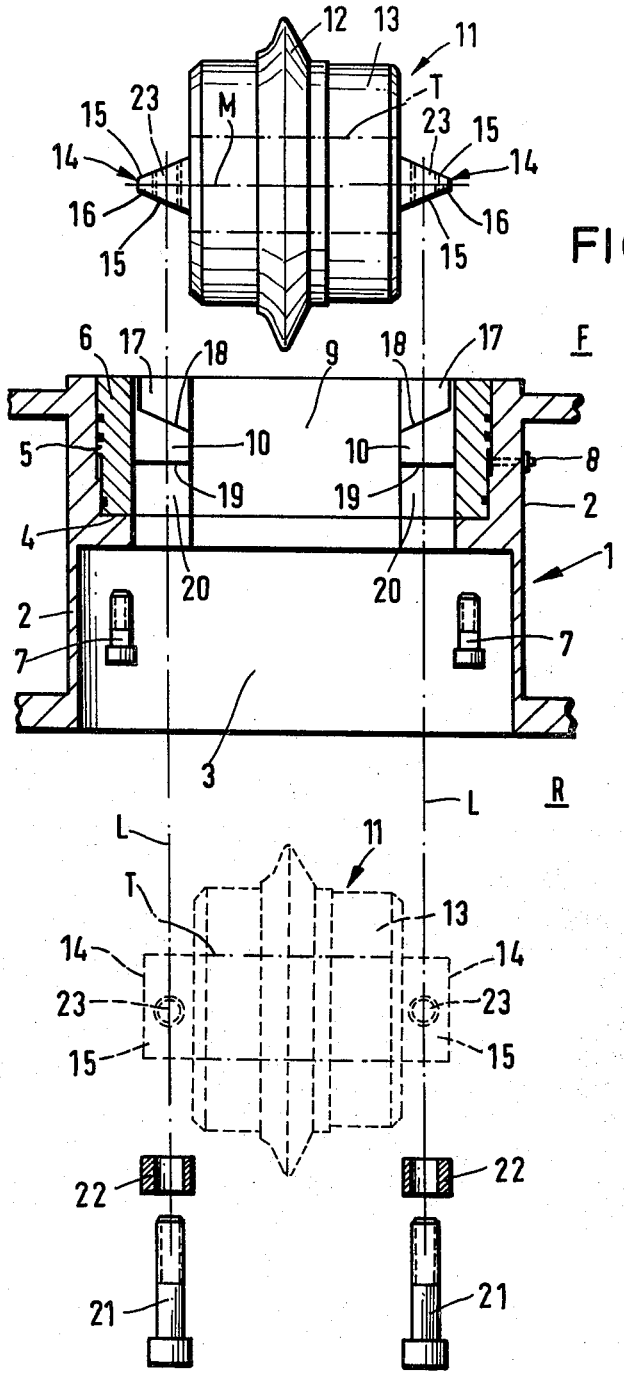
FIG. 1 is a partly cross-sectional exploded view of one embodiment of a holding device and tool according to the invention.

Referring firstly to FIGS. 1–4 there is shown a basic body member 1 which is a component of the boring head otherwise not illustrated of, for example, a tunnel boring machine. However, such a housing member can also be fastened on a boring head. The front of the boring head is indicated by the letter F and the rear of the boring head by the letter R. The basic member 1 has substantially cylindrical wall parts 2 which define an opening 3. The base member is provided in the front part with a bore 5 terminated by a shoulder 4 for an insert 6. The insert is inserted in the bore 5 in basic member 1 and can be fastened, for example, by screws 7. The insert can also be press fit in box 5 which can be released in a manner known per se by the use of a pressure medium, e.g. oil. A connection 8 for the pressure medium is indicated in FIG. 1.

The insert 6 accommodated in the basic member 1 forms the actual holder in this construction for a tool designated as a whole by the reference numeral 11. This is a so-called cutting roller in which a tool body 13 provided with a disc cutter 12 or the like is rotatably mounted in a known manner. An inner part, which forms the supporting member and is fixed with respect to the tool body, terminates in head parts 14 which serve to fasten the tool. In FIG. 1 the supporting member is indicated by the letter T and can be constructed according to requirements.

In the embodiment shown in FIGS. 1 to 4 the head parts 14 each have two opposed contact surfaces 15 inclined symmetrically with respect to a plane extending through the central axis M of the tool such that a cross sectional shape which is substantially triangular but with a truncated end results. The sides of these head parts 14 are indicated by the reference numeral 16 and have dimensions which are substantially smaller than the contact surfaces 15 extending at an angle to them.

Figure 3:
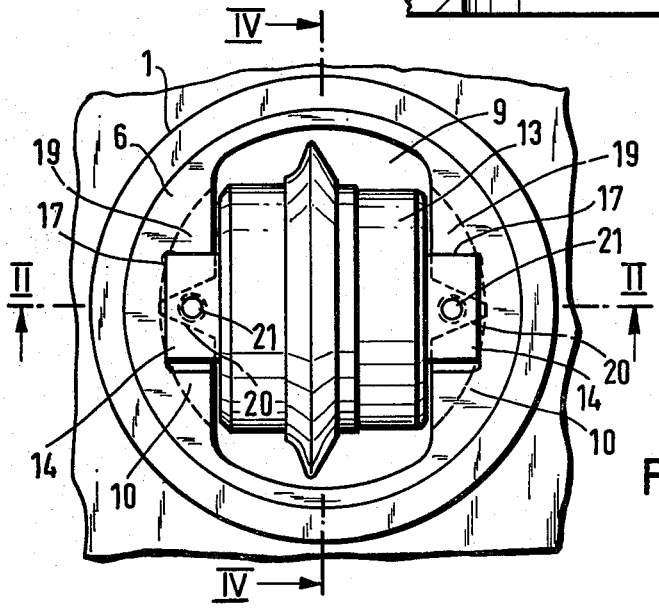
FIG. 3 is a top plan view of the assembled holding device and tool shown in FIG. 2.

As can be seen in particular from FIG. 3 the insert 6 has a generally rectangular opening 9, but two opposite sides are for example curved while the other two sides of the opening 9 are limited by substantially segment-shaped portions 10 of the insert 6, the inner surfaces of which face the ends of the tool body 13. These portions 10 have support surfaces 18 sunk in recesses 17, the support surfaces 18 having an inclination corresponding to the inclination of the contact surfaces 15 of the head parts 14.

Part of the rear surface of each portion 10 is forwardly disposed of the rear end of the insert 6 to form a plane surface 19. Grooves 20 start from the surfaces 19 and terminate in the region of the support surfaces 18 and in their cross sectional shape substantially correspond to that of the head parts 14, i.e. they have approximately the same triangular shape but are only somewhat larger.

Figure 2:
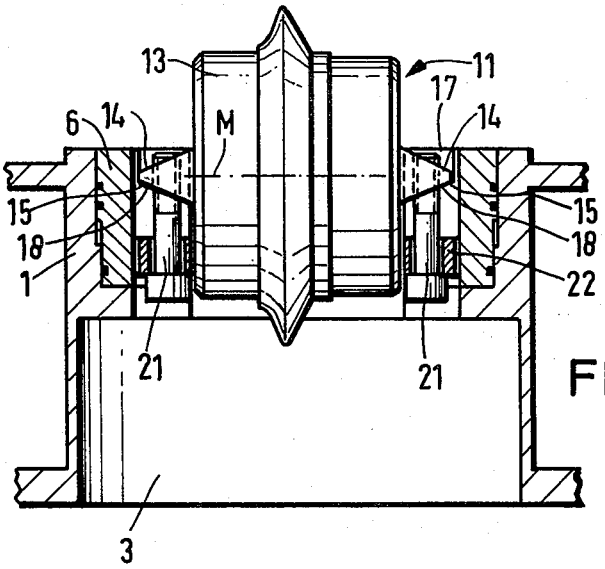
FIG. 2 is a cross-sectional view of the holding device and tool of FIG. 1 in the assembled state taken along line II—II in FIG. 3.
Figure 4:
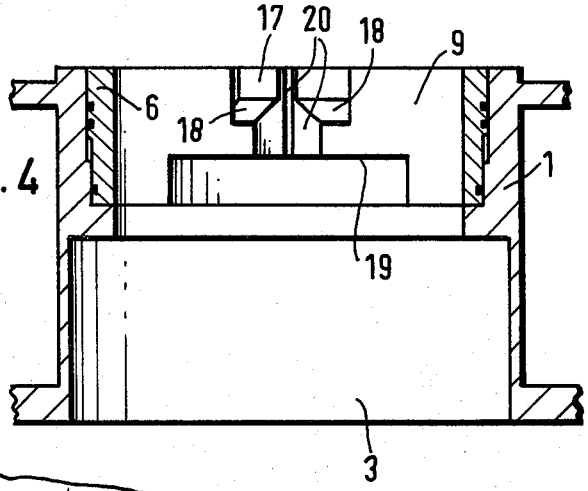
FIG. 4 is a cross sectional view through the holding device taken along line IV—IV of FIG. 3 but with the tool omitted.

FIG. 1 illustrates the assembly of a tool 11. It is inserted by hand or for example by means of a suitable tong or fork-shaped apparatus in the direction of the broken line L from the rear R of the boring head or the like into the opening 3 of the basic body member 1 and further into the insert 6. The head parts 14 are orientated in the position shown in phantom in FIG. 1, such that the latter can be inserted through the grooves 20 with their sides 16 forward of the support surfaces 18 until the head parts 14 are in or beyond the recesses 17. The tool 11 or its supporting body is then rotated such that the head parts 14 are displaced angularly by 90° with respect to their insertable position shown in phantom and the contact surfaces 15 extend parallel to the support surfaces 18 as the illustration of the tool 11 in the uppermost part of FIG. 1 shows, the distance of the in front holding device being exaggerated for clarity. In reality the tool only requires to be pushed forward to the extent that the rotation described is possible. In order to limit the path in the forward direction when required, attachments or the like can be provided on the insert or on the basic body member. The tool 11 is then moved back by a small amount until the surfaces 15 lie on the support surfaces 18. In this assembly position the tool 11 is then held by fastening screws 21. The latter pass through spacers 22 or the like which abut against the lower plane surfaces 19 of the portions 10 and are screwed-into threaded bores 23 in the head parts 14. The fastening screws 21 extend through the grooves 20 which had previously served to permit passage of the head pieces 14. The length of the spacers 22 can be selected such that the fastening screws 21 can receive the correct length for a desired initial state of tension. Instead of individual spacers a ring, a plate or the like with two passages can be provided for the fastening screws. The prepared assembled state of the tool 11 is shown in FIG. 2.

Figure 6:
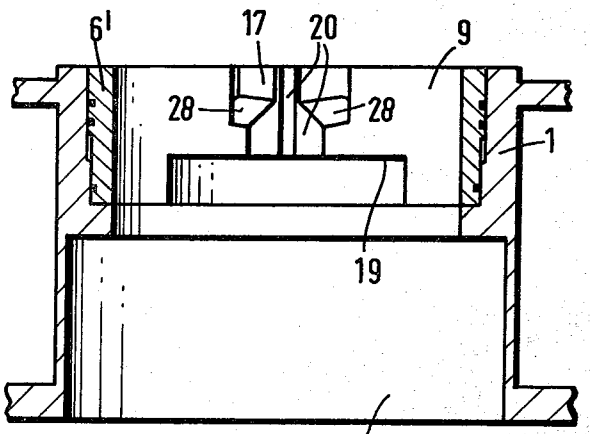
FIG. 6 is a cross sectional view similar to FIG. 4 of the holding device of FIG. 5 with the tool omitted.
Figure 7:
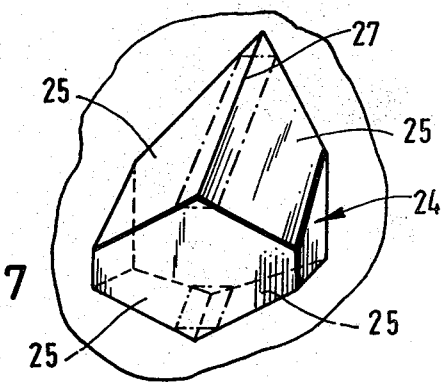
FIG. 7 is an enlarged detail view of a modified tool.
Figure 5:
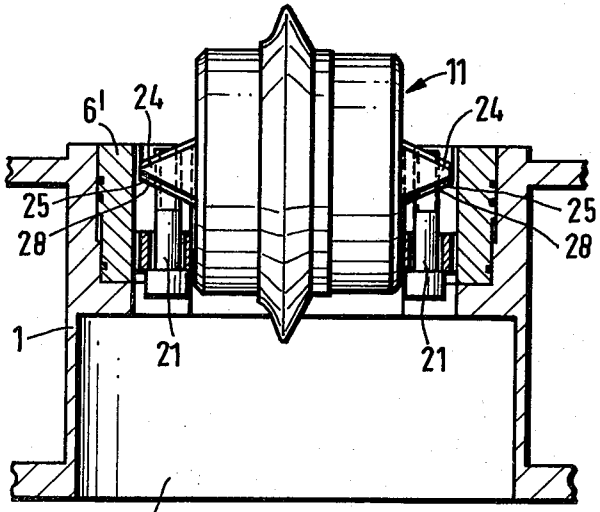
FIG. 5 is a cross sectional view similar to FIG. 2 of a further embodiment of the holding device with a tool assembled therein.

The embodiment shown in FIGS. 5 to 7 differs from that shown in FIGS. 1 to 4 essentially in that the contact surfaces 25 on the head parts 24 and accordingly the support surfaces 28 on the insert 6' are constructed so as to be roof-shaped. These surfaces are thus not only inclined so as to slope outwards but also have inclinations transverse thereto on either side. FIG. 7 shows the inclined surfaces 25 starting from a ridge 27, which can also be flattened as is indicated by broken lines, and inclined so as to slope forwards, in the example of a symmetrical arrangement.

In FIGS. 5 and 6 the same parts or parts corresponding to one another as in FIGS. 1 to 4 are designated by the same reference numerals.

The construction of the holding device can also be such that when the tool is mounted the angular position of the head parts of the supporting body of the tool is not altered but that the whole tool undergoes a rotation or pivoting movement about an axis perpendicular to the axis of rotation or the central axis M of the tool body 13, which perpendicular axis corresponds to a central axis of the holding device or extends parallel to the latter.

This can be illustrated with respect to FIG. 1 in following way. It may be assumed that the tool 11 is still behind the boring head; however in contrast to the lower part of FIG. 1 the supporting body with the head parts 14 is already in the orientation indicated in the tool shown in the upper part of FIG. 1 and the tool 11 is considered to be pivoted about a perpendicular axis in FIG. 1. When the size of the opening 3 and the opening 9 correspond the tool can then be pushed in a straight line through the holding device until the head parts 14 are exactly above the upper edge of the insert 6. The tool then only requires to be pivoted about the perpendicular axis or a central axis of the holding device until the head parts 14 are opposite the support surfaces 18, whereupon reverse movement finally brings the surfaces to rest. This is a locking movement similar to that of a bayonet catch.

The construction can also be such that the head parts are already guided at the time of the first forward movement and/or when the tool is rotated or pivoted. In this connection grooves of a corresponding size can be provided for example in the insert 6.

Figure 9:
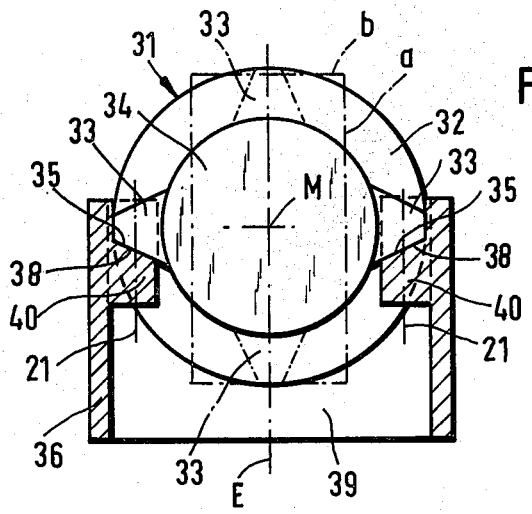
FIG. 9 is a cross sectional view taken along the line IX—IX of FIG. 8.
Figure 8:
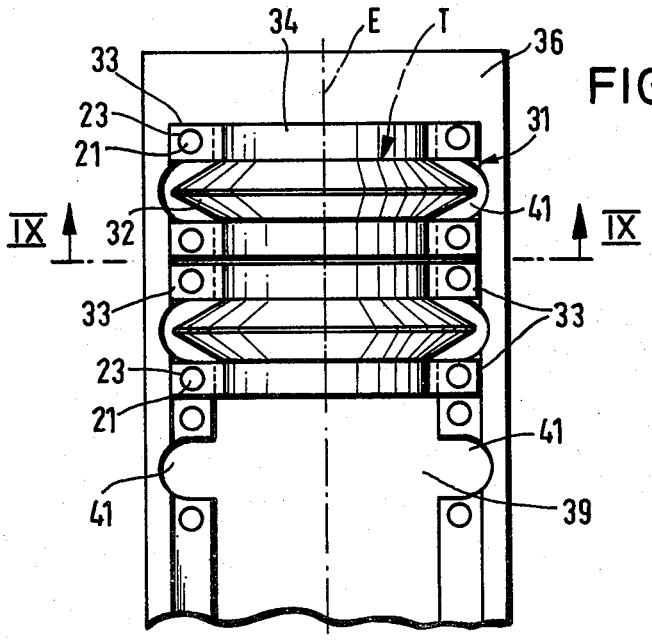
FIG. 8 is a plan view of another embodiment of the holding device.

A further embodiment of a holding device is shown in FIGS. 8 and 9. These illustrate not only a very simple possibility of movement but simultaneously also reproduce a construction for a tool or a tool multiple arrangement which in particular can be arranged in the central part of a boring head as a so-called center bore or the like.

A holder 36 fastened in a suitable manner to a boring head (not shown) or forming a part of the same is designed to accommodate a number of tools 31 side by side. Each tool 31 comprises a disc-shaped tool element 32 rotatably mounted on a supporting body T. Two substantially cylindrical head parts 34 of the supporting body, which between its ends can also form an axial guide for the tool element 32, each have two radially directed wing portions in the form of attachments 33 provided substantially diametrically opposite one another. The attachments have contact surfaces 35. As illustrated these are present on the upper and lower sides of the attachments 33, in a similar manner to the other constructions described, but in each case only on one side.

The holder 36 has a central opening 39 and inwardly directed projections 40. Support surfaces 38 for the contact surfaces 35 of the attachments 33 are defined by projections 40. The numeral 41 designates recesses which provide free space for the tool elements 32. The distance between the inner facing sides of the projections 40 i.e. the inside width of the holder 36 at this point is slightly greater than the diameter of the head pieces 34 without taking into consideration the attachments 33.

The insertion of a tool 31 into its final position on the holder 36 is achieved by initially rotating the head parts 34 with their attachments 33 such that the attachments point approximately in the direction of the longitudinal central plane E (vertical in FIG. 9) of the holder 36 as indicated in FIG. 9 by broken lines. In this position the tool 31 is inserted from the rear of the boring head and moved so far forwards that the central axis M of the tool lies in front of the support surfaces 38. The tool 31 or the supporting body with the head parts 34 is then rotated about the axis M such that the attachments 33 lie above the support surfaces 38 and the tool 31 only requires to be moved back by a small amount in order to bring the surfaces 35 to rest against the support surfaces 38. Fastening screws, which in FIG. 9 are merely indicated by broken lines, are pushed through corresponding passages in the projections 40 in a similar manner to the construction according to FIG. 1 and screwed in threaded bores 23 (FIG. 8) in the attachments 33. According to the construction of the holder the passages for the screws can have a circular cross section or be constructed as longitudinal holes or slots.

The contact surfaces 35 and the associated support surfaces 38 can extend parallel to a central plane of the tool or lie in such a plane that they can be inclined in one direction, as FIG. 9 shows. They can be roof-shaped or have another suitable construction and what has been stated above in connection with the other embodiments applies accordingly.

In the manner described each tool 31 can be assembled at its assembly position in the holder 36. However, it is also possible to construct the holder 36 such that all the tools are inserted only at one point e.g. at one end of the holder and after being rotated are then pushed parallel to the longitudinal axis of the holder to their final assembly position. The support surfaces 38 can lie in a continuous plane which only comprises corresponding openings for the tool elements or in each case can be arranged on the basis of individual recesses intended for each tool. The tools 31 can in each case be held per se by fastening screws 21. In this case there can be a contact or a slight distance between the ends of the head parts 34. The construction can however also be such that the head parts 34 of the tools 31 available are supported with their ends rigidly against one another, the last tool in the row being supported directly or via a filling member or the like at an end wall of the holder. In this case the fastening screws 21 can pass through correspondingly large openings or if appropriate through longitudinal holes in the projections.

Instead of being cylindrical the head parts of a tool can for example be of rectangular shape, as is indicated in FIG. 9 by broken lines, the opposite longer sides a forming contact surfaces and their distance from one another being smaller than the inside width of a passageway or of a corresponding opening, as in the example according to FIG. 9 the distance of the inner sides of the projections 40 from one another. The shorter sides are designated by the letter b.

The invention is not only suitable for tools with rotatable parts but can advantageously also be used for stationary tools or tools with rigid tool elements. This applies in particular to a boring head or tools to be attached to another carrier for operating in softer formations, especially tools constructed according to cutting picks or the like.

What I claim is:

1. In a boring head tool, or the like, having rear mounted tools wherein at least one tool is rotatably mounted on a tool supporting member which is removably attachable to a tool holder having a front and a rear, the improvement comprising: supporting heads extending outwardly from opposite sides of said tool supporting member each having a larger dimension in a direction perpendicular to said outwardly extending direction than the dimension in said outwardly extending direction, support surfaces on said heads, screw-threaded bores in said heads, rigid support surfaces on the tool holder substantially facing the front thereof and substantially conforming to said support surfaces on said heads to engage and rigidly support said tool supporting member by said support surfaces on said heads when said tool supporting member is in the attached operating position in the tool holder, fastening screws engageable with said tool holder and engageable in said screw-threaded bores to releasably retain said tool supporting member in operating position with said support surfaces in contacting engagement, a passage extending through said tool holder from the rear to the front thereof, and further passages extending through said rigid support surfaces on said tool holder, said passages having sizes and configurations to facilitate inserting said tool supporting member and tool thereon through said tool holder from the rear toward the front to at least the front side of said support surfaces on said tool holder while said tool supporting member is orientated with respect to said tool holder in a position offset from the attached operating position.

2. A boring head tool as claimed in claim 1, wherein said supporting heads extend axially with respect to and include the rotational axis of the tool.

3. A boring head tool as claimed in 1, wherein said supporting surfaces are provided on radially extending portions of the head parts.

4. A boring head tool as claimed in claim 1, wherein said further passages are in the form of grooves which terminate at said rigid support surfaces and have a size so that said supporting heads can be pushed through them in a position rotated by 90° with respect to the attached operating position of the tool.

5. A boring head tool as claimed in claim 4, wherein said fastening screws extend in said operating position through said grooves.

6. A boring head tool as claimed in claim 1, wherein at least some of the passages are in the form of grooves in said tool holder offset in a peripheral direction with respect to said rigid support surfaces, said grooves communicating with a region of said support surfaces on said tool holder so as to allow passage for said supporting heads.

7. A boring head tool as claimed in claim 1, and further comprising spacers with holes therethrough positioned between said fastening screws and said tool holder, said screws extending through said holes.

8. A boring head tool as claimed in claim 7, wherein said supporting heads have said support surfaces thereon inclined with respect to an axial plane of the tool and said rigid support surfaces on said tool holder are correspondingly inclined.

9. A boring head tool as claimed in claim 8, wherein said support surfaces of each supporting head are inclined equally to the axial plane of the tool.

10. A boring head tool as claimed in claim 1, wherein said tool holder comprises a base member and an insert releasably connected to said base member, said rigid support surfaces being on the insert.

11. A boring head tool as claimed in claim 10, wherein said insert has a substantially cylindrical peripheral outer wall and said tool holder has a corresponding substantially cylindrical inner wall to receive said insert.

12. A boring head tool as claimed in claim 1 wherein said rigid support surfaces on the tool holder are ledges extending outwardly with respect to said first mentioned passage.

13. A boring head tool as claimed in claim 1 wherein said further passages extend through said rigid support surfaces in said tool holder in a direction substantially parallel to the central axis of said first mentioned passage.

14. A boring head tool as claimed in claim 1 wherein said supporting heads have a triangular cross-sectional shape.

* * * * *